US011000138B2

(12) United States Patent
Komatick

(10) Patent No.: US 11,000,138 B2
(45) Date of Patent: May 11, 2021

(54) COMPRESSIBLE STORAGE PILLOW

(71) Applicant: Christopher Komatick, East Norristown, PA (US)

(72) Inventor: Christopher Komatick, East Norristown, PA (US)

( * ) Notice: Subject to any disclaimer, the term of this patent is extended or adjusted under 35 U.S.C. 154(b) by 227 days.

(21) Appl. No.: 16/246,683

(22) Filed: Jan. 14, 2019

(65) Prior Publication Data

US 2020/0054155 A1 Feb. 20, 2020

Related U.S. Application Data

(63) Continuation-in-part of application No. 29/659,923, filed on Aug. 14, 2018, now Pat. No. Des. 875,394.

(51) Int. Cl.

| | |
|---|---|
| ***A47G 9/10*** | (2006.01) |
| ***A45C 9/00*** | (2006.01) |
| ***A45C 13/10*** | (2006.01) |

(52) U.S. Cl.

CPC ..... *A47G 9/1045* (2013.01); *A45C 9/00* (2013.01); *A45C 13/103* (2013.01); *A45C 13/1069* (2013.01); *A45C 13/1092* (2013.01); *A47G 9/1027* (2013.01); *A47G 2009/1018* (2013.01)

(58) Field of Classification Search

CPC ..... A47G 9/10; A47G 9/1045; A47G 9/1027; A47G 9/1054; A47G 9/1072; A47G 9/1081; A47G 9/109; A47G 2009/1018; A45C 9/00; A45C 13/103; A45C 13/1069; A45C 13/1092

See application file for complete search history.

(56) References Cited

U.S. PATENT DOCUMENTS 4,200,942 A 5/1980 Case
4,222,468 A * 9/1980 De Fries ..... A45C 3/10 190/102
4,267,868 A * 5/1981 Lowe ..... A45C 7/0063 383/2

(Continued)

FOREIGN PATENT DOCUMENTS

WO 9944477 A1 9/1999

OTHER PUBLICATIONS

Morningwood Log Pillow with Secret Pocket; Morningwood Collective; Jul. 16, 2018; https://www.kickstarter.com/projects/1386561735/morningwood-log-pillow-with-secret-pocket?ref=discovery&ref=discovery&term=pillo.

*Primary Examiner* — Robert G Santos
*Assistant Examiner* — Rahib T Zaman
(74) *Attorney, Agent, or Firm* — Boudwin Intellectual Property; Daniel Boudwin

(57) ABSTRACT

A compressible storage pillow designed to allow an individual to store items within a pouch that can also be utilized as a pillow. The compressible storage pillow includes a cylindrical fabric member having a circular first end opposite a circular second end, with a central cavity extending between the two. A fastener is at the first end and is designed to secure to a mated fastener on a top cover. Another fastener is at the second end and is designed to secure to a mated fastener on a bottom cover. The top cover and the bottom cover each have straps extending therefrom. Each strap has a strap fastener at a distal end, such that the top cover is designed to removably secure to the bottom cover. In this way, a user is able to securely store items in a pouch that can then be utilized as a pillow.

11 Claims, 4 Drawing Sheets

(56) References Cited

U.S. PATENT DOCUMENTS

D272,300 S * 1/1984 Dziurman, Jr. ..... 5/644
4,841,587 A * 6/1989 Carter ..... A45C 3/10 455/344
5,435,025 A * 7/1995 Gerard ..... A45C 3/10 5/417
5,457,829 A 10/1995 Elliott
5,584,086 A * 12/1996 VanWinkle ..... A47C 20/021 5/490
5,906,413 A 5/1999 Yang
5,918,332 A * 7/1999 Dees ..... A47G 9/1045 383/4
6,023,797 A 2/2000 Brumfield
6,041,458 A * 3/2000 Vickers ..... A47G 9/10 5/490
6,748,615 B1 * 6/2004 Tiedemann ..... B60N 2/882 5/640
6,951,038 B1 10/2005 Ganoe
7,131,156 B1 * 11/2006 Walker-Craft ..... A47G 9/1045 5/655
7,677,271 B2 3/2010 Boettner et al.
7,962,984 B2 * 6/2011 Popp ..... A61G 7/075 5/640
8,205,282 B2 6/2012 Brogan et al.
8,321,978 B1 12/2012 Fulton
8,672,401 B2 3/2014 Schreiber
9,756,921 B2 * 9/2017 Bergman ..... A45C 3/10
9,833,087 B1 12/2017 Richardson
D815,460 S 4/2018 Beyda
2006/0200910 A1 * 9/2006 Taylor ..... A47C 7/0213 5/652
2008/0137994 A1 * 6/2008 Urbina ..... E01H 1/1206 383/41
2015/0113734 A1 4/2015 Arabo
2015/0366382 A1 12/2015 Ostolaza-Torres
2017/0027346 A1 2/2017 Konigsberg
2017/0164663 A1 6/2017 Korenek et al.
2018/0049938 A1 * 2/2018 Fleming ..... A47G 9/1081
2018/0064269 A1 3/2018 Carlile

* cited by examiner

COMPRESSIBLE STORAGE PILLOW

CROSS REFERENCE TO RELATED APPLICATIONS

This application claims the benefit of U.S. patent application Ser. No. 29/659,923 filed on Aug. 14, 2018. The above identified patent applications are herein incorporated by reference in its entirety to provide continuity of disclosure.

BACKGROUND OF THE INVENTION

The present invention relates to compressible pillows. More specifically, the invention provides a compressible storage pillow having a cylindrical fabric member with a central cavity as well as a fastener on opposing sides which removably affix to a top cover and a bottom cover, respectively.

Many individuals become stranded at some point while traveling. However, these individuals are often forced to choose between carrying a backpack or a pillow on their journey. Although a user could choose to bring both, it is often cumbersome for the person to carry around multiple items. Additionally, if traveling on an airplane, the total number of items an individual can carry with them is restricted. Thus, an improved compressible storage pillow that can allow a user to store multiple items therein while also functioning as a comfortable pillow is desired.

SUMMARY OF THE INVENTION

In view of the foregoing disadvantages inherent in the known types of pillow now present in the known art, the present invention provides a compressible storage pillow wherein the same can be utilized for providing convenience for the user when desiring to securely store items in a pouch that can then be utilized as a pillow.

The present system comprises a compressible storage pillow. The compressible storage pillow comprises a cylindrical fabric member having a first end disposed opposite a second end, wherein a distance between the first end and the second end defines a length of the cylindrical fabric member. The first end and the second end each have an annular shape such that the first end has a first diameter and the second end has a second diameter. A central cavity is disposed at a center of the cylindrical fabric member extending the entire length therethrough.

In one embodiment, the cylindrical fabric member includes an inflatable bladder having an aperture configured to accept a valve of a pump. The aperture is in communication with the interior of the inflatable bladder, such that the user can fill the inflatable bladder with air. The inflatable bladder can maintain an inflated configuration, wherein the inflatable bladder is expanded and filled with air, and a deflated configuration, wherein the inflatable bladder has no air within and is compact such that the inflatable bladder can be folded for storage.

At least one fastener is disposed about a perimeter of the first end of the cylindrical fabric member, wherein the first end is configured to secure to a mated fastener disposed about a perimeter of a top cover. At least one fastener is disposed about a perimeter of the second end, wherein the second end is configured to secure to a mated fastener disposed about a perimeter of a bottom cover. The top cover and the bottom cover each include a plurality of straps extending therefrom, wherein each strap has a strap fastener at a distal end thereof such that the top cover is configured to removably secure to the bottom cover. In this way, a user is able to securely store items in a pouch that can then be utilized as a pillow.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
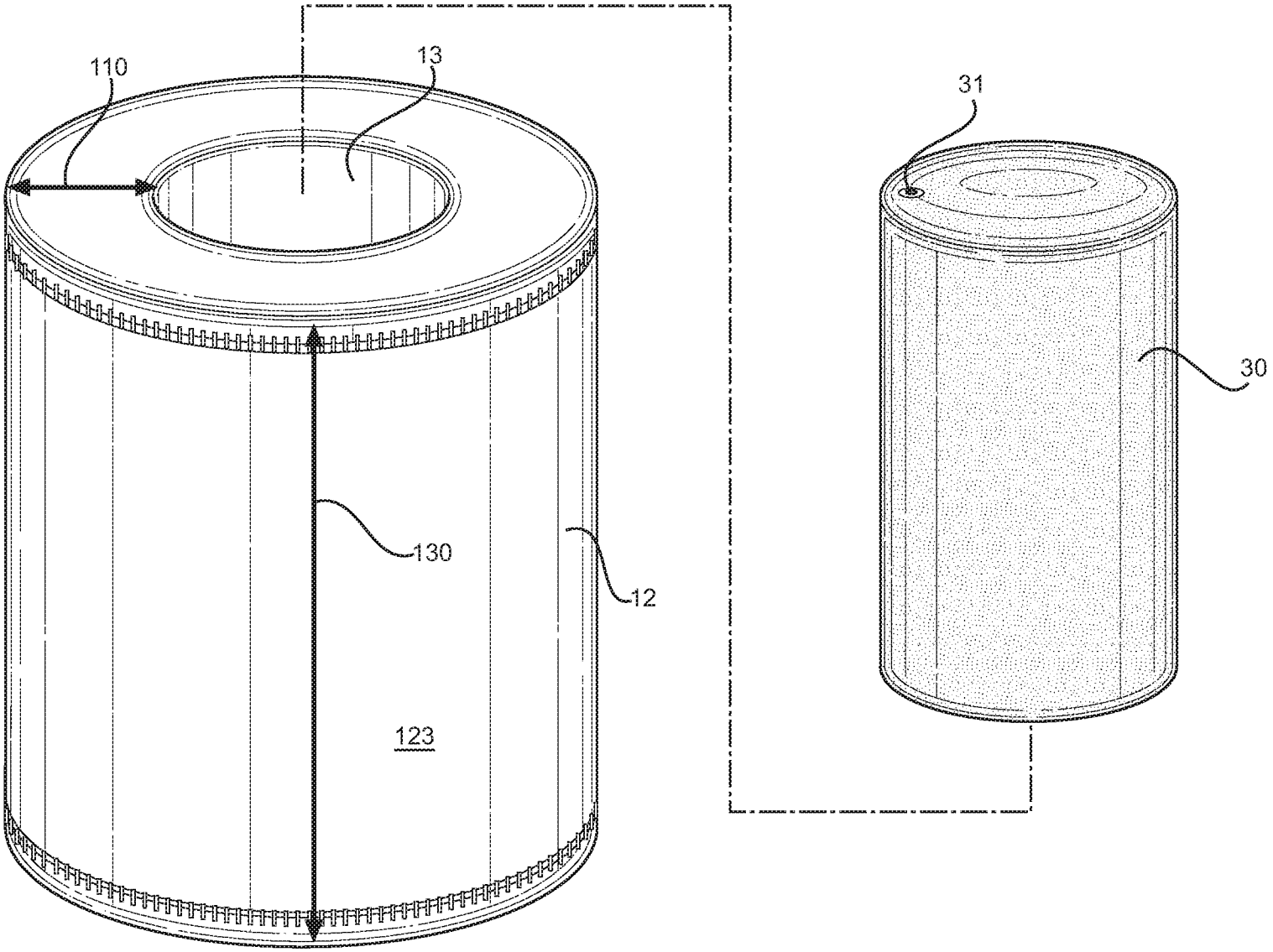
FIG. 1 shows a perspective view of an embodiment of the cylindrical fabric member of the compressible storage pillow.

Reference is made herein to the attached drawings. Like reference numerals are used throughout the drawings to depict like or similar elements of the compressible storage pillow. The figures are intended for representative purposes only and should not be considered to be limiting in any respect.

Referring now to FIG. 1, there is shown a perspective view of an embodiment of the cylindrical fabric member of the compressible storage pillow. A compressible storage pillow comprises a cylindrical fabric member 12 having a first end disposed opposite a second end. The cylindrical fabric member 12 additionally has a length 130, wherein the length 130 is defined as the distance between the first end of the cylindrical fabric member 12 and the second end of the cylindrical fabric member 12. In the illustrated embodiment, the length 130 is appropriately dimensioned such that a user can rest their head along the length 130 of the cylindrical fabric member 12.

Both the first end of the cylindrical fabric member 12 and the second end of the cylindrical fabric member 12 are annularly shaped, such that the first end includes a first diameter and the second end includes a second diameter. In the shown embodiment, the first diameter is equivalent to the second diameter, such that the cylindrical fabric member 12 does not taper towards the first end or the second end and is consistently linear throughout the entire length 130. In this way, the cylindrical fabric member 12 provides a consistent height throughout, regardless of where the user rests their head along the length 130 of the cylindrical fabric member 12.

The cylindrical fabric member 12 further comprises a central cavity 13 that extends throughout the length 130 of the cylindrical fabric member 12, thereby allowing the user to store one or more items therein. The central cavity 13 is disposed at a center of the first end of the cylindrical fabric member 12 and extends through the length 130 to a center of the second end of the cylindrical fabric member 12. In the illustrated embodiment, the central cavity 13 is annularly shaped, such that the central cavity 13 includes a cavity diameter. In the shown embodiment, the central cavity 13 is linear such that the cavity diameter is equivalent throughout the length 130 without tapering. In this way, the central cavity 13 provides a consistent storage space throughout the length 130 for the user.

In the illustrated embodiment, the cylindrical fabric member 12 additionally comprises an inflatable bladder 30, having an aperture 31 configured to accept a valve of a pump. The aperture 31 is in communication with the interior of the inflatable bladder 30, such that the user can fill the inflatable bladder 30 with air. The inflatable bladder 30 includes an inflated configuration, as shown, wherein the inflatable bladder 30 is expanded and filled with air, and a deflated configuration, wherein the inflatable bladder 30 has no air within and is compact such that the inflatable bladder 30 can be folded for storage. In the inflated configuration, the inflatable bladder 30 is dimensioned to fit within the central cavity 13 of the cylindrical fabric member 12 such that the inflatable bladder 30 is flush within an interior surface of the cylindrical fabric member 12. The user can decide how much air to inflate the inflatable bladder 30 with, thereby allowing the user to control the level of firmness provided by the cylindrical fabric member 12. Thus, the user is allowed a greatest degree of firmness when the inflatable bladder 30 is in the inflated configuration and inserted into the central cavity 13 to provide additional support for the user.

In the shown embodiment, the cavity diameter is equivalent to half the diameter of the first end. In this way, the central cavity 13 defines an outer radius 110 at the first end of the cylindrical fabric member 12, wherein the outer radius 110 extends from a perimeter of the central cavity 13 to a perimeter of the first end. Thus, in the illustrated embodiment, the outer radius 110 is equivalent to a cavity radius of the central cavity 13.

Additionally, the cylindrical fabric member 12 comprises an exterior surface 123. In the illustrated embodiment, the exterior surface 123 is planar, such that the exterior surface 123 provides a smooth and even texture therearound. In this way, the planar aspect of the exterior surface 123 promotes a level of comfort to the user, thereby encouraging them to use the cylindrical fabric member 12 as a pillow or headrest. In an additional embodiment, the exterior surface 123 includes an indicium thereon, such that the user can decorate or customize their cylindrical fabric member 12. In a further embodiment, the exterior surface 123 is quilted, thereby ensuring the foam material of the cylindrical fabric member 12 is not displaced when the cylindrical fabric member 12 is compressed during use.

Figure 2A:
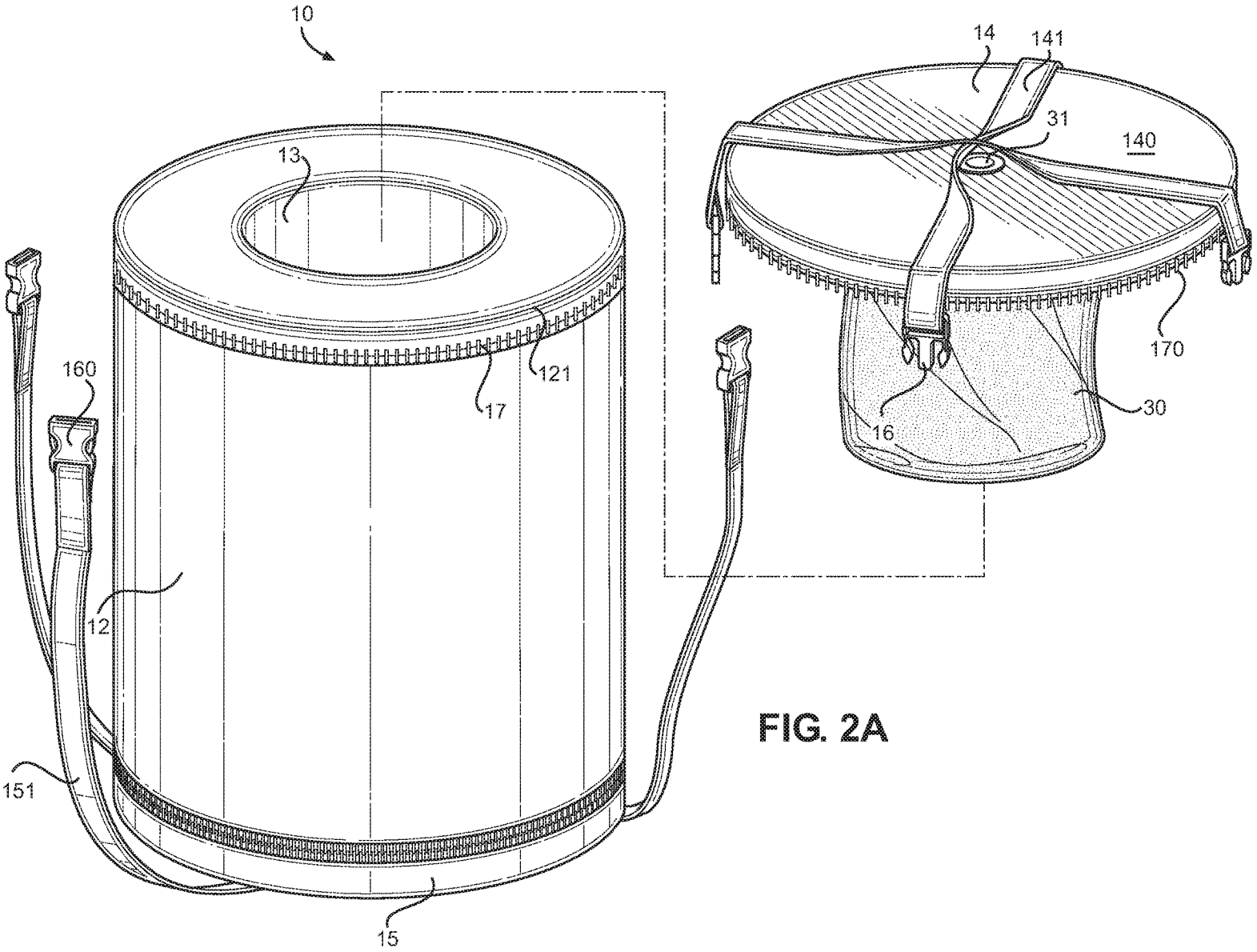
FIG. 2A shows a perspective view of an embodiment of the compressible storage pillow with the top cover removed and the bottom cover secured.

Referring now to FIG. 2A, there is shown a perspective view of an embodiment of the compressible storage pillow with the top cover removed and the bottom cover secured. The first end of the cylindrical fabric member 12 includes at least one fastener 17 disposed therearound an outer perimeter 121. The compressible storage pillow 10 further comprises a top cover 14 configured to removably secure to the first end of the cylindrical fabric member 12. As such, the top cover 14 includes a mated fastener 170 disposed therearound a perimeter of the top cover 14. In the illustrated embodiment, the first end fastener 17 and the mated top cover fastener 170 are zippers, such that the user can easily remove a portion of the top cover 14 to access the central cavity 13 without fully removing the top cover 14, thereby preventing the user from accidentally misplacing the top cover 14 when removed. In the illustrated embodiment, the top cover 14 is annularly shaped, such that the top cover 14 is configured to have a shape and diameter corresponding to the first end of the cylindrical fabric member 12.

The top cover 14 further comprises a top exterior surface 140, wherein the top exterior surface 140 is configured to be exposed to the user when the top cover 14 is secured atop the first end of the cylindrical fabric member 12. A plurality of top straps 141 are affixed to the top exterior surface 140 of the top cover 14. In the illustrated embodiment, the plurality of top straps are each permanently secured to the top exterior surface 140 through a fastener such as sewing seams, or another suitably secure fastener. In the shown embodiment, the plurality of top straps 141 comprises a pair of top straps, wherein the top straps 141 are configured to overlap one another in an X configuration atop the top exterior surface 140.

In the illustrated embodiment, the inflatable bladder 30 is permanently affixed to the top cover 14, thereby making it more difficult to accidentally misplace the inflatable bladder 30 while additionally making it easier to consistently utilize the inflatable bladder 30. In the shown embodiment, the inflatable bladder 30 is partially deflated, as the user can choose the amount of air disposed within the inflatable bladder 30, thereby allowing the user to determine the firmness of the inflatable bladder 30 and cylindrical fabric member 12. In the illustrated embodiment, the aperture 31 used to fill the inflatable bladder 30 is disposed on the top exterior surface 140. In this way, the user is able to easily fill the inflatable bladder 30 when the top cover 14 is affixed to the cylindrical fabric member 12 without having to remove the top cover 14 to access the inflatable bladder 30.

The compressible storage pillow 10 further comprises a bottom cover 15 configured to removably secure to the second end of the cylindrical fabric member 12. Similar to the first end of the cylindrical fabric member 12, the second end of the cylindrical fabric member 12 includes at least one fastener disposed therearound an outer perimeter. As such, the bottom cover 15 also includes a mated fastener disposed therearound a perimeter of the bottom cover 15. In the illustrated embodiment, the fastener disposed along the perimeter the second end and the mated fastener disposed along the perimeter of the bottom cover 15 are both zippers. Thus, the user can easily remove a portion of the bottom cover 15 to access the central cavity 13 without fully removing the bottom cover 15, thereby preventing the user from accidentally misplacing the bottom cover 15 when removed. In the illustrated embodiment, the bottom cover 15 is annularly shaped, such that the bottom cover 15 is configured to have a shape and diameter corresponding to the first end of the cylindrical fabric member 12.

The bottom cover 15 further comprises a bottom exterior surface, wherein the bottom exterior surface is configured to be exposed to the user when the bottom cover 15 is secured therearound the fabric member 12. A plurality of bottom straps 151 are secured atop the bottom exterior surface of the bottom cover 15. In the illustrated embodiment, the plurality of bottom straps 151 are each permanently secured to the bottom exterior surface through a fastener such as sewing seams, or another suitably secure fastener. In the shown embodiment, the plurality of bottom straps 151 comprises a pair of bottom straps, wherein the bottom straps 151 are configured to overlap one another in an X configuration atop the bottom exterior surface.

Additionally, the top straps 141 have a top fastener 16 disposed at a distal end thereof while the bottom straps 151 have a mated bottom fastener 160 disposed at a distal end thereof, wherein the top fastener 16 of the top straps 141 is configured to removably secure to the bottom fastener 160.

In the illustrated embodiment, the top fasteners 16 and mated bottom fasteners 160 are buckle clips to allow the user to easily fasten and unfasten the fasteners, however, in other embodiments any other secure fastener can be used. Further, the bottom straps 151 are dimensioned to reach along the full length of the cylindrical fabric member 12, such that the bottom straps 151 can be secured to the top straps 141 thereby.

Figure 2B:
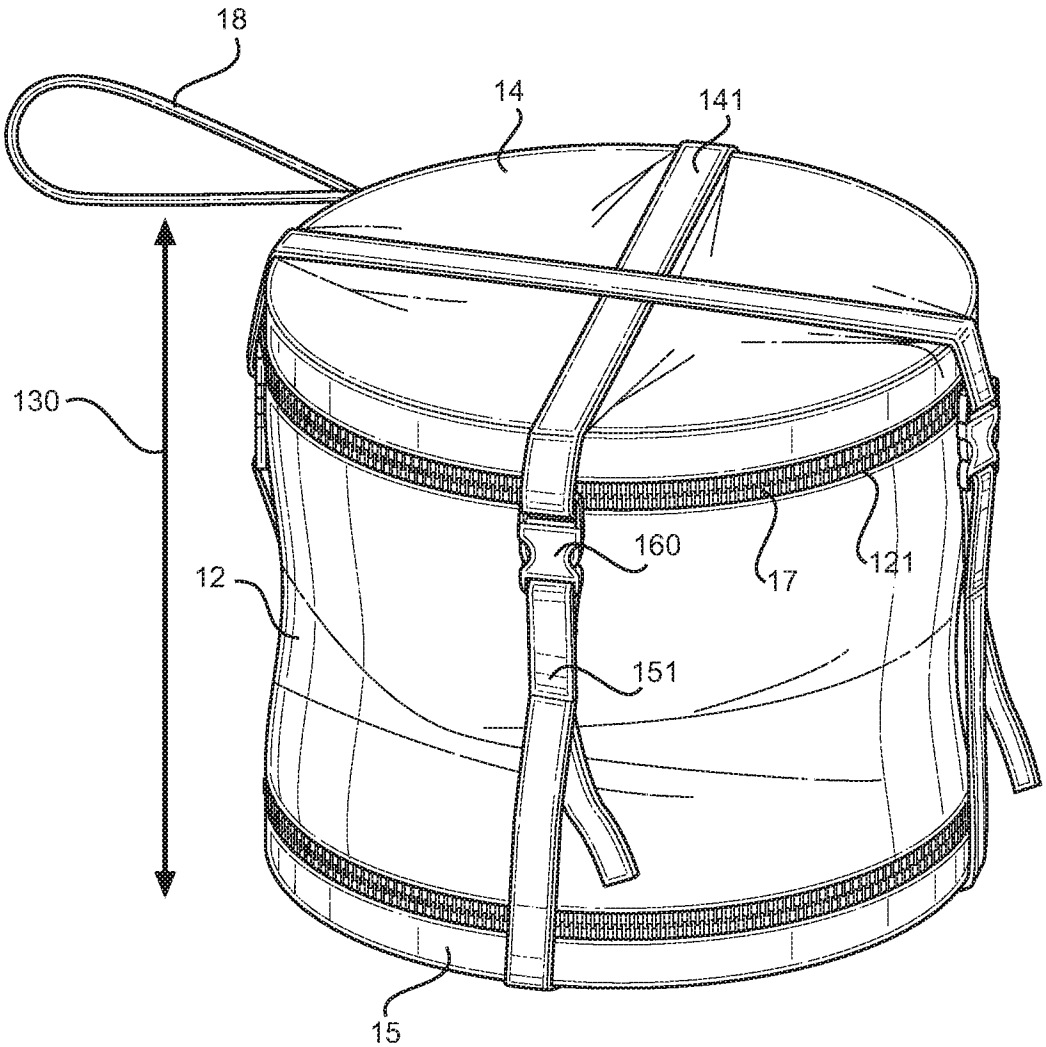
FIG. 2B shows a perspective view of an embodiment of the compressible storage pillow compressed.

Referring now to FIG. 2B, there is shown a perspective view of an embodiment of the compressible storage pillow compressed. After the top cover 14 and bottom cover 15 are each secured to the cylindrical fabric member 12 through the fastener 17, the top straps 141 are securely fastened to the bottom straps 151, thereby allowing the user to compress the compressible storage pillow. Once compressed, the length 130 of the cylindrical fabric member 12 is decreased, thereby making it easier to for the user to store the compressible storage pillow.

In the illustrated embodiment, the bottom straps 151 further comprise a tightening mechanism, such that by pulling on a desired portion of the bottom strap 151, the user can shorten the bottom strap 151, thereby compressing that section of the cylindrical fabric 12 the respective bottom strap 151 runs along. Additionally, in the shown embodiment, the top cover 14 further comprises a carrying strap 18, such that the user can easily transport the compressible storage pillow in the compressed form.

Figure 3:
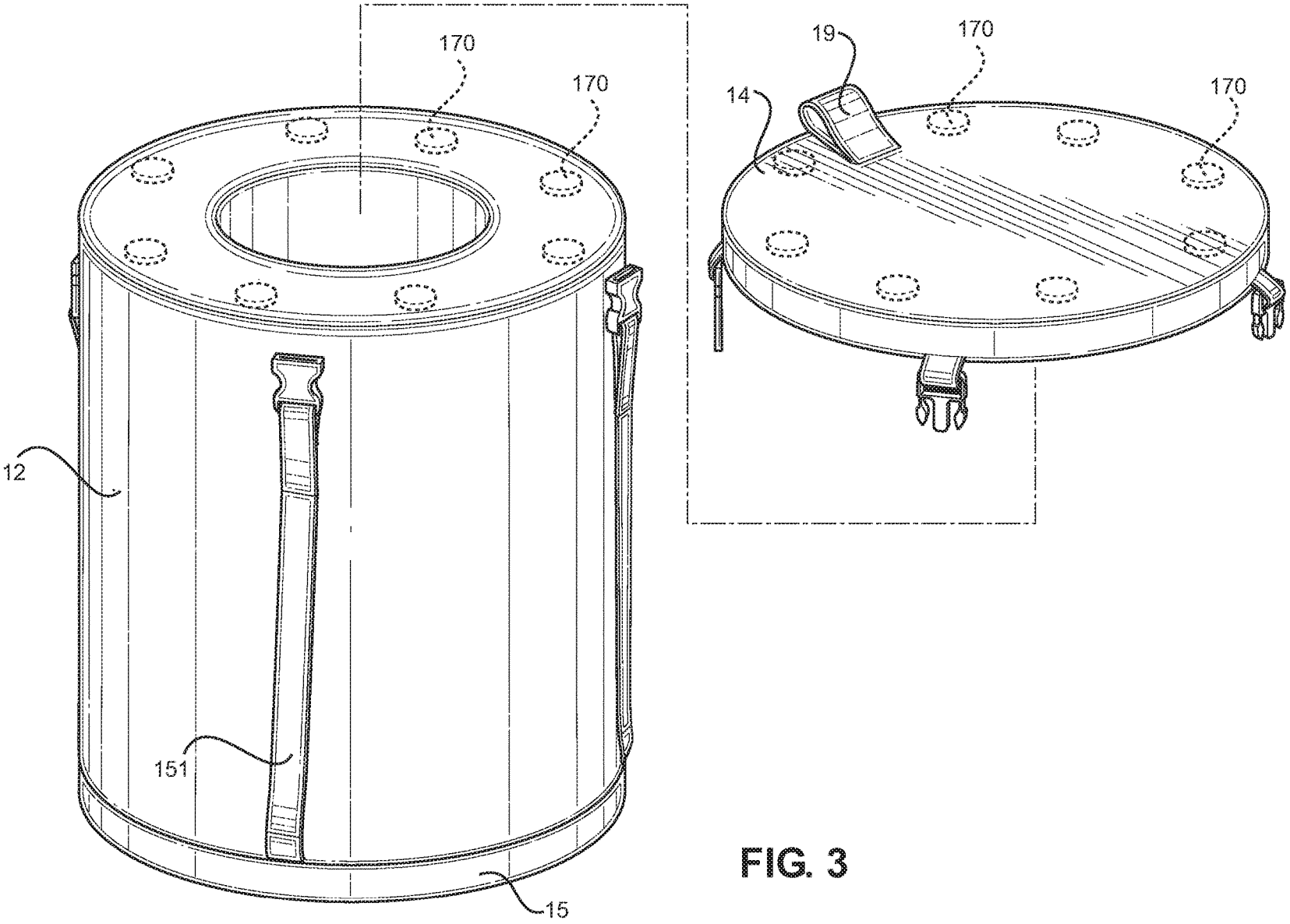
FIG. 3 shows another perspective view of an embodiment of the compressible storage pillow with the top cover removed and the bottom cover secured.

Referring now to FIG. 3, there is shown another perspective view of an embodiment of the compressible storage pillow with the top cover removed and bottom cover secured. In the illustrated embodiment, the first end fasteners 170 disposed therearound the perimeter of the first end of the cylindrical fabric member 12 comprises a plurality of magnets. In the illustrated embodiment, the plurality of magnets 170 are permanently secured in an interior of the cylindrical fabric member 12, proximal to the surface of the first end of the cylindrical fabric member 12. In the shown embodiment, the plurality of magnets 170 are disposed about a center perimeter of the cylindrical fabric member 12, such that the plurality of magnets 170 are disposed equidistant from the outer perimeter of the cylindrical fabric member 12 and the perimeter of the central cavity 13. In this way, the plurality of magnets 170 do not interfere with any items, such as electronics or ferromagnetic metals, stored within the central cavity 13.

Additionally, the top cover 14 includes a plurality of mated magnets 170 configured to removably secure to the plurality of magnets 170 disposed within the first end of the cylindrical fabric member. Thus, the top cover fasteners 170 are correspondingly disposed around the perimeter of the top cover 14, such that the top cover fasteners 170 are aligned with the plurality of magnets 170 disposed in the first side of the cylindrical fabric member 12. Accordingly, the bottom cover 15 is configured to removably secure to the second side of the cylindrical fabric member 12 in manner similar to that used for the top cover 14. Thus, the bottom cover 15 also includes a plurality of bottom cover fasteners configured to removably secure to a plurality of magnets disposed in the second side of the cylindrical fabric member 12. In the illustrated embodiment, the fabric material proximate to the plurality of magnets 170 is reinforced, such that repeated usage does not damage the cylindrical fabric member 12 or the top cover 14 through repetitive strain.

Additionally, in the shown embodiment, the top cover 14 further comprises a pull tab 19, wherein the pull tab 19 is oriented in a looped formation, such that the pull tab 19 includes an aperture thereby allowing the user to easily loop a finger therein to grasp the pull tab 19. The pull tab 19 is permanently secured to the top cover 14, such that the user can remove the top cover 14 via utilizing the pull tab 19.

In the illustrated embodiment, the top cover 14 is unsecured to the cylindrical fabric member 12, while the bottom cover 15 is secured to the cylindrical fabric member 12. However, the plurality of straps 151 are secured to the bottom cover 15, such that the user is still able to tighten and thereby compress the cylindrical fabric member 12.

In operation, a user desiring to nap will take the compressible storage pillow and remove the top cover, the bottom cover, or both to store one or more items within the central cavity of the cylindrical fabric member. The user will then ensure the top cover and the bottom cover are securely attached prior to tightening or loosening the straps to adjust the length and firmness of the pillow to the user's desired specifications, prior to resting their head atop the cylindrical fabric member.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A compressible storage pillow, comprising:

a cylindrical fabric member having a first end disposed opposite a second end, wherein a distance between the first end and the second end defines a length of the cylindrical fabric member;

the first end and the second end each having an annular shape such that the first end has a first diameter and the second end has a second diameter;

a central cavity disposed at a center of the cylindrical fabric member extending the entire length therethrough;

at least one fastener disposed about a perimeter of the first end;

at least one fastener disposed about a perimeter of the second end;

a top cover having a mated fastener disposed on a perimeter therearound configured to secure to the first end of the cylindrical fabric member and having a plurality of straps extending therefrom;

a bottom cover having a mated fastener disposed on a perimeter therearound configured to secure to the second end of the cylindrical fabric member and having a plurality of straps extending therefrom;

an inflatable bladder removably secured within the central cavity, wherein the inflatable bladder is dimensioned to fit flush within the central cavity when the inflatable bladder is in a fully inflated configuration;

wherein each strap of the top cover and each strap of the bottom cover have a strap fastener at a distal end thereof such that the top cover is configured to removably secure to the bottom cover;

wherein the cylindrical fabric member is configured to compress in a direction from the top cover toward the bottom cover when the plurality of straps are tightened in a secured configuration.

2. The compressible storage pillow of claim 1, wherein an exterior surface of the cylindrical fabric member is planar.

3. The compressible storage pillow of claim 1, wherein the first diameter of the cylindrical fabric member is equivalent to the second diameter of the cylindrical fabric member.

4. The compressible storage pillow of claim 3, wherein the central cavity has a diameter equivalent to half the diameter of the first diameter of the cylindrical pillow.

5. The compressible storage pillow of claim 1, wherein the top cover is annularly shaped and includes a pull tab attached thereto.

6. The compressible storage pillow of claim 5, wherein the top cover has a diameter equivalent to the first end of the cylindrical fabric member.

7. The compressible storage pillow of claim 1, wherein the bottom cover has a diameter equivalent to the second end of the cylindrical fabric member.

8. The compressible storage pillow of claim 1, wherein the plurality of straps disposed atop the top cover are oriented in an X position such that a first strap overlaps a second strap.

9. The compressible storage pillow of claim 1, wherein the plurality of straps disposed atop the bottom cover are oriented in an X position such that a first strap overlaps a second strap.

10. The compressible storage pillow of claim 1, wherein the fasteners comprise a zipper.

11. The compressible storage pillow of claim 1, wherein the fasteners comprise a plurality of magnets.

* * * * *